United States Patent [19]

Chitester

[11] 3,936,108

[45] Feb. 3, 1976

[54] FILE CABINET DRAWER LOCKING MECHANISM

[75] Inventor: John Alvin Chitester, Long Beach, N.Y.

[73] Assignee: Oxford Pendaflex Corporation, Garden City, N.Y.

[22] Filed: Feb. 24, 1975

[21] Appl. No.: 552,104

[52] U.S. Cl. ..... 312/217; 70/82; 312/219

[51] Int. Cl.[2] ..... E05B 65/46

[58] Field of Search ..... 70/82, 84–86; 292/98–99, 102, 106, 127, 129; 312/216, 219, 217

[56] References Cited

UNITED STATES PATENTS

| | | | |
|---|---|---|---|
| 2,091,382 | 8/1937 | Swimmer | 70/182 |
| 3,883,200 | 5/1975 | Latham | 312/216 |
| 3,888,558 | 6/1975 | Himsl | 312/216 |

*Primary Examiner*—Paul R. Gilliam
*Assistant Examiner*—Carl F. Pietruszka
*Attorney, Agent, or Firm*—Darby & Darby

[57] ABSTRACT

A locking mechanism for file cabinet drawers having a receding front wall includes a vertically movable elongated rod with horizontally extending projections which is positioned adjacent the side walls of the drawers on one side of the file cabinet; a rotatable shaft supported beneath the bottom wall of each drawer and extending beyond the side walls of each drawer; and a locking member mounted on the shaft between each drawer side wall and the file cabinet casing. A camming surface on the locking member on the side of the cabinet adjacent the rod is engaged by the projection on the upwardly moving rod causing the shaft to rotate and thereby actuating both locking members into engagement with both sides of the receding drawer front wall. The locking member on the other side of the cabinet also engages a retainer element attached to the file cabinet casing.

9 Claims, 5 Drawing Figures

FILE CABINET DRAWER LOCKING MECHANISM

BACKGROUND OF THE INVENTION

File cabinets may be generally characterized as having either rigid drawer fronts or receding drawer fronts or a combination of the two. The receding drawer front file cabinets may be either shelf-type cabinets or the pullout drawer-type cabinets. This invention particularly relates to pullout drawer-type file cabinets having receding drawer fronts.

In rigid drawer front file cabinets, it is conventional to provide a vertically movable elongated rod or locking bar which permits all of the drawers in the file cabinet to be locked by a key. Generally speaking, the locking bar extends the height of the file cabinet and has horizontally projecting members which can be moved into the path of travel of corresponding tabs or projections on the file cabinet drawers to prevent the opening of these drawers when the rod is in a locked position. However, this locking mechanism is not satisfactory for receding drawer front file cabinets in which the drawer pulls out and, in addition, the drawer front recedes.

Another problem in providing a satisfactory locking mechanism for a receding drawer front file cabinet is that the receding drawer front is usually extremely flexible so that if only one side of the receding drawer front is locked, it is still possible to pull back the other side of the receding drawer front when a pulling force is applied to the handle located in the middle of the receding drawer front.

SUMMARY OF THE INVENTION

The locking mechanism of this invention overcomes the above-mentioned difficulty and provides a positive locking mechanism for both sides of the receding drawer front which prevents the receding drawer front from being opened, and also prevents the file cabinet drawer from being pulled out.

Briefly stated, the locking mechanism of this invention includes a vertically movable elongated rod having a plurality of horizontally extending projections which is mounted in one side of the file cabinet causing adjacent the side walls of the file cabinet drawers; a rotatable shaft which is supported beneath the bottom wall of each of the drawers; a pair of locking members mounted on each end of the rod; and a retaining element which is attached to the other side of the file cabinet casing.

In operation, when it is desired to lock the file cabinet drawers, a key or other mechanism is used to lift the elongated bar into its locked position so that the horizontal projections on the bar are positioned in the path of travel of corresponding projections or tabs on the horizontally extending file drawers. As the rod moves upwardly, each projection engages a camming surface on the locking member nearest to the rod causing the shaft on which the locking member is mounted to rotate so that the locking portions of both locking members rotate into engagement with the rear surface of the receding drawer front. Also, the locking member farthest from the rod engages a retaining element which is mounted on the filing cabinet casing wall farthest from the rod so that that side of the receding drawer front is also positively locked.

Structural features of the invention and the complete nature thereof will become increasingly apparent following a consideration of the ensuing specification and the appended claims in which the invention is defined, particularly when taken in conjunction with the accompanying illustrative drawings which set forth a preferred embodiment of the invention.

DESCRIPTION OF A PREFERRED EMBODIMENT

Figure 1:
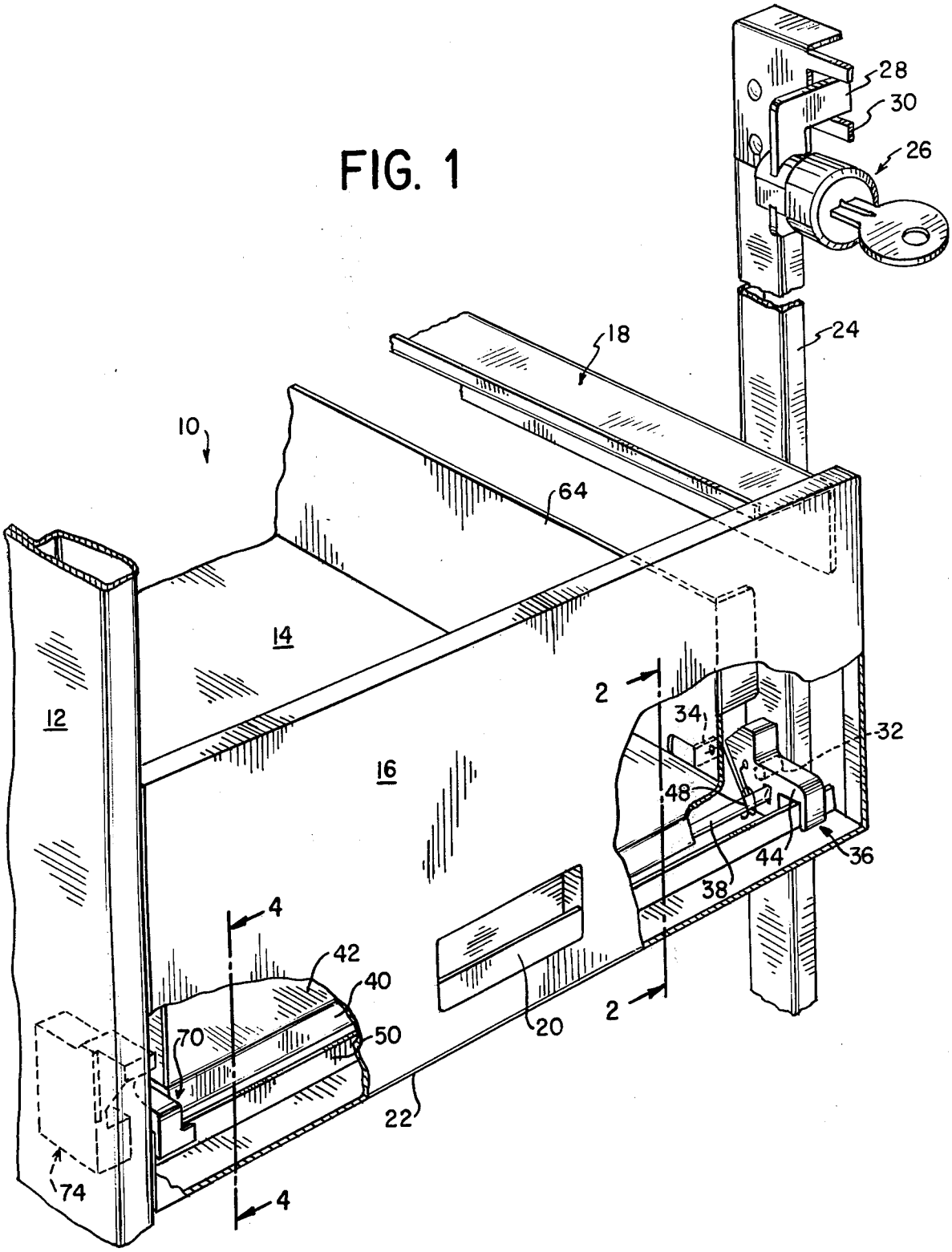
FIG. 1 is a perspective view of one drawer of a receding drawer front file cabinet with parts broken away.

Referring now to FIG. 1, the three basic parts of the file cabinet 10 consist of the file cabinet outer casing 12, the file cabinet drawer 14, and the receding drawer front 16. The receding drawer front 16 is pivotally mounted on a pair of spaced rails 18 (only the right-hand rail is shown in the drawings, the left-hand rail being a mirror image of the right-hand rail) which is attached to the file cabinet outer casing 12. The receding drawer front 16 pivots about a laterally extending axis generally coincident with the top edge of the drawer front. The drawer is opened by grasping a handle 20 located in the middle of the drawer front and pulling it outwardly and upwardly (see arrow in FIG. 5) so that the drawer rotates about the laterally extending axis to a position where the drawer front is substantially parallel to the rail 18. Then, the bottom edge 22 of the drawer front 16 can be pushed rearwardly so that the drawer front recedes into the file cabinet along the rails 18. In the drawer front's receded position, the bottom edge 22 of the drawer front is coincident with the front edge of the rails 18. When the drawer front is in its receded position, the drawer can be pulled out from the file cabinet casing.

An elongated rod 24 is located in a channel in the right side of the file cabinet casing. The rod moves vertically upwardly and downwardly. The vertical movement of the rod 24 is controlled by a key mechanism 26. When the key is turned to the locked position, camming member 28 on the key mechanism moves upwardly and engages the notch 30 in the rod thereby causing the rod to move upwardly. To unlock the file cabinet, the key is turned in the other direction, and the camming member 28 and the rod 24 move downwardly.

Figure 2:
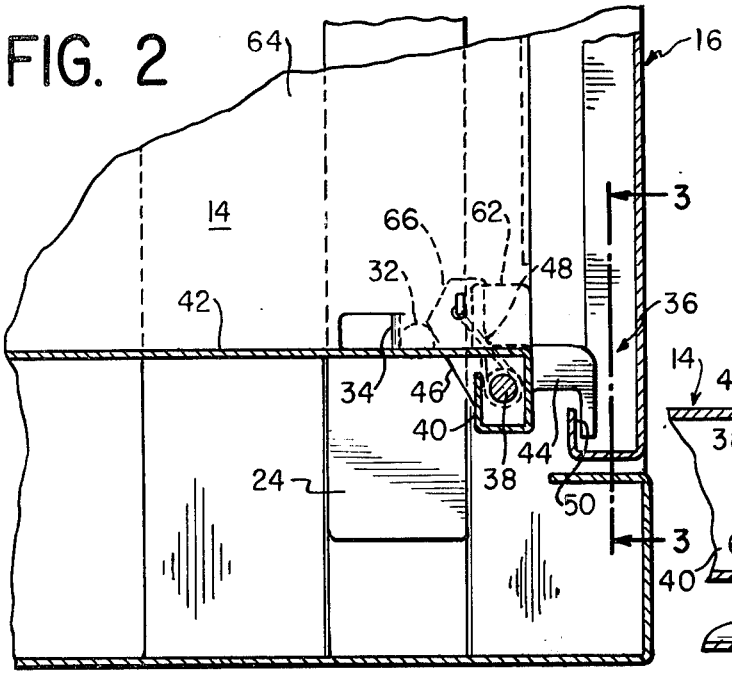
FIG. 2 is a cross-sectional view of a portion of the locking mechanism of this invention taken along the lines 2—2 in FIG. 1.

Referring now to FIGS. 1 and 2, elongated rod 24 is shown in the locked position. Projections 32 extend horizontally from rod 24 toward the side walls of the file cabinet drawers. When the rod is in the locked position, projection 32 is positioned in front of a tab 34 extending from drawer 14 towards the rod 24. Since projection 32 is in the path of travel of tab 34 in the locked position, drawer 16 cannot be pulled out from the file cabinet casing.

A first locking member 36 is mounted on a shaft 38 which extends across the width of the file cabinet drawer 14. Shaft 38 is located in a rectangular casing 40 which is formed below the front edge of the bottom surface 42 of the file cabinet drawer 14. The shaft 38 extends through apertures 60 in plates 62 which are attached to both sides 64 of the drawer 14 and which cover the side openings formed by rectangular housing 40. Any other conventional means of supporting the rod for rotational movement could be used in place of the above-described support plates 62.

Locking member 36 consists of a front C-shaped portion 44 and a rear camming surface 46 and is positioned between the file cabinet drawer side 64 and the elongated bar 24.

Figure 3:
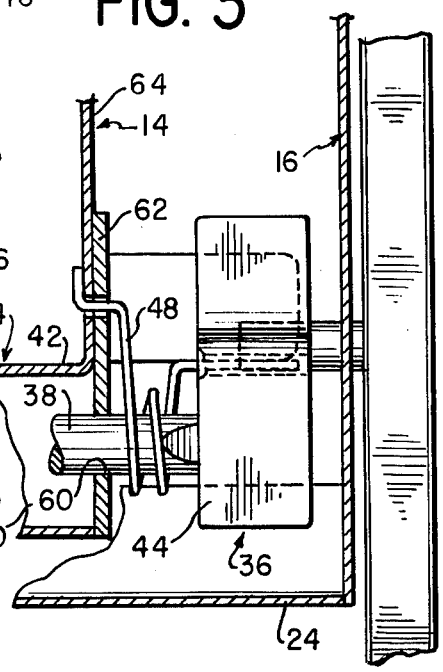
FIG. 3 is a cross-sectional view of a portion of the locking mechanism illustrated in FIG. 2 taken along the lines 3—3.
Figure 5:
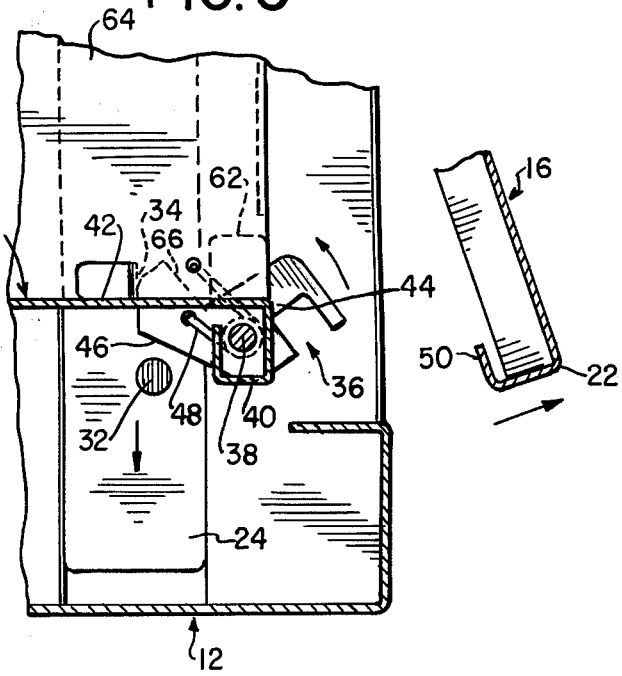
FIG. 5 is a view similar to FIG. 2 showing a portion of the locking mechanism illustrated in FIG. 1 in an unlatched position.

Referring now to FIG. 3, a wire spring 48 is wound about the shaft 38 in order to spring-load the locking member 36 to the unlocked position illustrated in FIG. 5. The spring 48 causes the locking member 36 to rotate counterclockwise (with reference to FIG. 5) and out of engagement with the lip or channel 50 which is formed across the rear surface of the receding drawer front 16.

One end of spring 48 extends through apertures in the plate 62 and the side of the file cabinet drawer 64. The other end of the spring is inserted into an aperture in the locking member 36. Instead of the spring member 48 to urge the locking member 36 to the retracted position illustrated in FIG. 5, any other suitable means may be used.

Referring to FIG. 2, as the elongated rod projection 32 moves upwardly from the position illustrated in FIG. 5 to the position illustrated in FIG. 2, projection 32 engages the camming surface 46 of the locking member 36 and causes the locking member to pivot in a clockwise direction (referring to FIG. 2) so that the C-shaped portion 44 engages the lip 50 of the receding drawer front 16.

Referring still to FIG. 2, a stop surface 66 is provided on the locking member 36. The stop surface bears against the tab 34 when the locking bar 24 is moved downwardly to the position illustrated in FIG. 5. FIG. 5 illustrates the stop surface 66 of the locking member 36 engaging the tab 34 on the file cabinet drawer to prevent locking member 36 from rotating in a counterclockwise direction (referring to FIG. 5) any further than from the position illustrated in FIG. 5.

Figure 4:
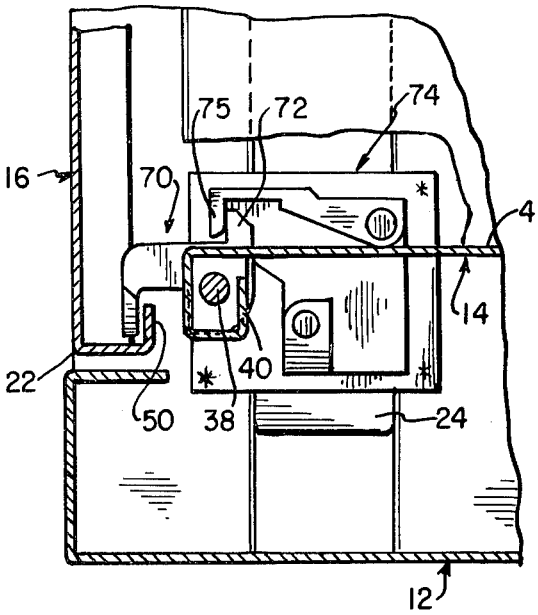
FIG. 4 is a cross-sectional view of the locking mechanism illustrated in FIG. 1 taken along the lines 4—4.

Referring now to FIG. 4, the left side of the receding drawer front locking mechanism is illustrated. A second locking member 70 is mounted on the rotatable shaft 38 in the same manner as locking member 36 so that when the projection 32 on the locking bar 24 moves upwardly, causing locking member 36 and shaft 38 to rotate in a clockwise direction (referring to FIG. 2), locking member 70 also rotates in a counterclockwise direction (referring to FIG. 4) to engage lip 50 of the receding drawer front in the same manner as locking member 36.

Locking member 70 is also provided with a vertically extending tab portion 72 which engages a retaining element 74 which is attached to the left side of the file cabinet. The retaining element 72 has a downwardly depending lip 75 which is engaged by the upwardly extending tab on the left-hand locking member 70. Since the retaining element 72 is directly attached to the file cabinet housing, the locking mechanism of this invention provides positive locking of both sides of the receding drawer front.

While the principles of the invention have now been made clear in the illustrative embodiment, it is entirely conceivable that upon examining the foregoing disclosure, those skilled in the art may devise embodiments of the concept involved which differ somewhat from the embodiments shown and described herein, or may make various changes in structural details to the present embodiment. For example, the locking members 36 and 70 could be positioned on either side of the file cabinet, the locking bar 24 could be moved downwardly into locking position, and the shape of the various portions of the locking members could be changed. Consequently, all such changed embodiments or variations of structure as utilize the concepts of the invention and clearly incorporate the spirit thereof are to be considered as within the scope of the claims appended herebelow.

What is claimed is:

1. A locking mechanism for a file cabinet having a plurality of horizontally extensible drawers positioned one atop the other within a casing, each of said drawers having front and rear ends, a bottom wall, opposing first and second side walls, and a receding front wall being part of said casing, comprising:

an elongated rod positioned adjacent said drawer first side wall, means for moving said rod vertically upwardly to a locked position and vertically downwardly to an unlocked position, a projection extending inwardly from said rod towards said drawer first side wall;

a shaft supported beneath the front end of the drawer bottom wall and extending beyond said drawer first and second walls; means for rotatably supporting said shaft, a first locking member rigidly mounted on said rotatable shaft and positioned between said first side wall and said rod, said first locking member including means for engaging and locking said drawer receding front wall adjacent said drawer first side wall and means cooperating with said projection for actuating said first locking member into locking engagement with said drawer receding front wall;

a retainer element attached to said casing adjacent said drawer second side wall and extending inwardly towards said drawer second side wall;

a second locking member positioned between said drawer second side wall and said casing, said second locking member including means for engaging and locking said casing receding front wall adjacent said drawer second side wall and means for engaging said retainer element;

means attached to said first locking member for actuating said second locking member into locking engagement with said casing receding front wall.

2. The locking mechanism recited in claim 1, further comprising a tab member extending outwardly from said drawer first side wall towards said rod, said projection being positioned in the path of travel of said drawer tab member when said rod is in the locked position.

3. The locking mechanism recited in claim 1, said first locking member engaging and locking means and said second locking member engaging and locking means each comprising a generally C-shaped portion.

4. The locking mechanism recited in claim 3, said first locking member cooperating means comprising a camming surface inclined downwardly from the end of the bottom leg of the C-shaped portion.

5. The locking mechanism recited in claim 4, further comprising a stop surface being formed on said first locking member, said stop surface extending upwardly from the lowermost portion of said camming surface.

6.The locking mechanism recited in claim 5 said second locking member retainer engaging means comprising a tab extending horizontally from the rear surface of the C-shaped portion in a direction opposite to the legs of said C-shaped portion when said second locking member is in an unlocked position.

7. The locking mechanism recited in claim 1, further comprising means attached to said first locking member for urging said first locking member out of engagement with said drawer receding front wall.

8. The locking mechanism recited in claim 1, said urging means comprising a spring wound about said shaft, said spring first end being attached to said first locking member.

9. A locking mechanism for a file cabinet having a plurality of horizontally extensible drawers positioned one atop the other within a casing, each of said drawers having front and rear ends, a bottom wall, opposing first and second side walls and a receding front wall comprising:

an elongated rod positioned adjacent said drawer first side wall, means for moving said rod vertically upwardly to a locked position and vertically downwardly to an unlocked position, a projection extending inwardly from said rod towards said drawer first side wall;

a shaft supported beneath the front end of the drawer bottom wall and extending beyond said drawer first and second walls; means for rotatably supporting said shaft;

a first locking member rigidly mounted on said rotatable shaft and positioned between said drawer first side wall and said rod, said first locking member including a generally C-shaped portion for engaging and locking said drawer receding front wall adjacent said drawer first side wall, and a camming surface in the path of travel of said projection;

a retainer element attached to said casing and having a horizontal surface extending towards said drawer second side wall;

a second locking member rigidly mounted on said rotatable shaft and positioned between said drawer second side wall and said casing, said second locking member including a generally C-shaped portion for engaging and locking said drawer receding front wall adjacent said drawer second side wall, and a tab extending horizontally from said C-shaped portion in a direction opposite to the legs of said C-shaped portion for engaging said retainer element.

* * * * *